US007963342B2

(12) United States Patent
George

(10) Patent No.: US 7,963,342 B2
(45) Date of Patent: Jun. 21, 2011

(54) DOWNHOLE ISOLATION VALVE AND METHODS FOR USE

(75) Inventor: Kevin R. George, Cleburne, TX (US)

(73) Assignee: Marathon Oil Company, Houston, TX (US)

( * ) Notice: Subject to any disclaimer, the term of this patent is extended or adjusted under 35 U.S.C. 154(b) by 167 days.

(21) Appl. No.: 11/469,230

(22) Filed: Aug. 31, 2006

(65) Prior Publication Data

US 2008/0078553 A1 Apr. 3, 2008

(51) Int. Cl.

| | |
|---|---|
| ***E21B 29/00*** | (2006.01) |
| ***E21B 33/10*** | (2006.01) |
| ***E21B 34/06*** | (2006.01) |
| ***E21B 43/112*** | (2006.01) |

(52) U.S. Cl. ..... 166/386; 166/55; 166/298; 166/332.8

(58) Field of Classification Search ..... 166/313, 166/386, 297, 298, 55, 332.8

See application file for complete search history.

(56) References Cited

U.S. PATENT DOCUMENTS

| | | | | |
|---|---|---|---|---|
| 2,191,750 | A * | 2/1940 | Brown | 166/63 |
| 3,375,874 | A * | 4/1968 | Cherry et al. | 166/114 |
| 4,393,930 | A * | 7/1983 | Ross et al. | 166/188 |
| 5,249,630 | A * | 10/1993 | Meaders et al. | 166/373 |
| 5,496,044 | A * | 3/1996 | Beall et al. | 277/336 |
| 5,799,949 | A * | 9/1998 | Beall et al. | 277/300 |
| 6,260,850 | B1 * | 7/2001 | Beall et al. | 277/314 |
| 6,283,477 | B1 * | 9/2001 | Beall et al. | 277/314 |
| 6,386,288 | B1 * | 5/2002 | Snider et al. | 166/298 |
| 6,394,187 | B1 * | 5/2002 | Dickson et al. | 166/383 |
| 6,942,034 | B2 * | 9/2005 | Harmon et al. | 166/297 |
| 6,973,970 | B2 * | 12/2005 | Johnston et al. | 166/298 |
| 7,255,178 | B2 * | 8/2007 | Slup et al. | 166/386 |
| 7,287,596 | B2 * | 10/2007 | Frazier et al. | 166/332.8 |
| 7,325,616 | B2 * | 2/2008 | de Cardenas et al. | 166/313 |
| 7,703,538 | B2 * | 4/2010 | Johnson et al. | 166/375 |
| 2002/0007949 | A1 * | 1/2002 | Tolman et al. | 166/280 |
| 2003/0136562 | A1 * | 7/2003 | Robison et al. | 166/298 |
| 2003/0234104 | A1 * | 12/2003 | Johnston et al. | 166/298 |
| 2006/0124311 | A1 * | 6/2006 | de Cardenas et al. | 166/313 |
| 2007/0295511 | A1 * | 12/2007 | Johnson et al. | 166/374 |

* cited by examiner

*Primary Examiner* — Jennifer H Gay

(74) *Attorney, Agent, or Firm* — Jack E. Ebel

(57) ABSTRACT

A method and apparatus for actuating a downhole tool in a wellbore. The method and apparatus including an actuator that operates the tool in response to the functioning of an energetic charge. The energetic charge may be set off as a part of a perforating operation.

40 Claims, 5 Drawing Sheets

DOWNHOLE ISOLATION VALVE AND METHODS FOR USE

BACKGROUND OF THE INVENTION

1. Field of the Invention

Embodiments of the present invention generally relate to downhole tools and methods for operating downhole tools. More particularly, embodiments of the present invention relate to apparatus and methods for actuating downhole tools in response to perforating a downhole tubular. More particularly still, embodiments of the present invention relate to apparatus and methods for actuating a downhole valve using a chemically energetic charge.

2. Description of the Related Art

In the drilling of oil and gas wells, a wellbore is formed using a drill bit disposed at a lower end of a drill string that is urged downwardly into the earth. After drilling a predetermined depth, the drill string and bit are removed and the wellbore is lined with a string of casing. An annular area is thereby formed between the string of casing and the formation. A cementing operation is then conducted in order to fill the annular area with cement. The combination of cement and casing strengthens the wellbore and facilitates the isolation of certain areas or zones behind the casing including those containing hydrocarbons. The drilling operation is typically performed in stages and a number of casing strings may be run into the wellbore until the wellbore is at the desired depth and location.

During the life of the well a number of downhole tools are used in order to maximize the production of different producing zones in the well. The casing is typically perforated adjacent a hydrocarbon bearing formation using a series of explosive or "perforating" charges. Such a series of charges are typically run into the well bore inside of an evacuated tube and that charge containing tube is known as a "perforating gun." When detonated, the charges pierce or perforate the walls of the casing and penetrate the formation thereby allowing fluid communication between the interior of the casing and the formation. Production fluids may flow into the casing from the formation and treatment fluids may be pumped from the casing interior into the formation through the perforations made by the charges.

In many instances a single wellbore may traverse multiple hydrocarbon bearing formations that are otherwise isolated from one another within the Earth. It is also frequently desirable to treat such hydrocarbon bearing formations with pressurized treatment fluids prior to producing those formations. In order to ensure that a proper treatment is performed on a desired formation, that formation is typically isolated during treatment from other formations traversed by the wellbore. To achieve sequential treatment of multiple formations, the casing adjacent a lowermost formation is perforated while the casing portions adjacent other formations common to the wellbore are left un-perforated. The perforated zone is then treated by pumping treatment fluid under pressure into that zone through the perforations. Following treatment, a downhole plug is set above the perforated zone and the next sequential zone up hole is perforated, treated and isolated with an above positioned plug. That process is repeated until all of the zones of interest have been treated. Subsequently, production of hydrocarbons from these zones requires that the sequentially set plugs be removed from the well. Such removal requires that removal equipment be run into the well on a conveyance string which may typically be wire line coiled tubing or jointed pipe.

In the above described treatment process the perforation and plug setting steps each represent a separate excursion or "trip" into and out of the wellbore with the required equipment. Each trip takes additional time and effort and adds complexity to the overall effort. Such factors can be exacerbated when operating in wellbores that are not vertical and specialized conveyance equipment is often required in "horizontal" wellbores.

Therefore, there is a need for a capability of performing multiple downhole process steps in a single trip. Further, there is a need for a system that can perforate one zone and isolate another zone in the same trip. There is a need for a device that closes the bore of a casing upon receipt of an impulse from a downhole source. There is a further need for actuating downhole tools during a perforating operation. There is a need for a downhole isolation valve that can be actuated by an explosive charge.

SUMMARY OF THE INVENTION

In accordance with the present invention there is provided generally a downhole isolation valve that can be actuated by an energetic device. Further provided are methods for isolating downhole formations and performing other well bore operations in a single trip.

More specifically the present apparatus comprises a well bore casing string comprising:

at least one valve member having a first position wherein a bore of a casing is substantially unobstructed and a second position wherein the bore is substantially closed;

at least one fluid chamber having a first pressure configuration isolated from a fluid pressure there around and a second pressure configuration wherein the fluid pressure is communicated through a boundary of the chamber; and at least one valve retainer operatively coupled between the fluid chamber and the valve member, the valve retainer configured to move in response to the communicated fluid pressure and thereby facilitate movement of the valve member from the first position to the second position.

Further, the present methods comprise isolating a portion of a well bore comprising:

providing a valve member for obstructing a bore of a casing in the well bore;

providing a first fluid flow path having a first predetermined location, from the well bore to a formation surrounding the well bore, the valve member being located along the well bore between the first predetermined location and an earth surface opening of the well bore; and opening a second fluid flow path, having a second predetermined location, through a wall of the casing and obstructing the bore of the casing with the valve member, by activating a first energetic device, the second predetermined location being along the well bore between the valve member and the Earth surface opening.

BRIEF DESCRIPTION OF THE DRAWINGS

So that the above recited features may be understood in more detail, a more particular description of the features, briefly summarized above, may be had by reference to embodiments, some of which are illustrated in the appended drawings. It is to be noted, however, that the appended drawings illustrate only typical embodiments of the present invention and are therefore not to be considered limiting of its scope, for the invention may admit to other equally effective embodiments.

DETAILED DESCRIPTION

Figure 1:
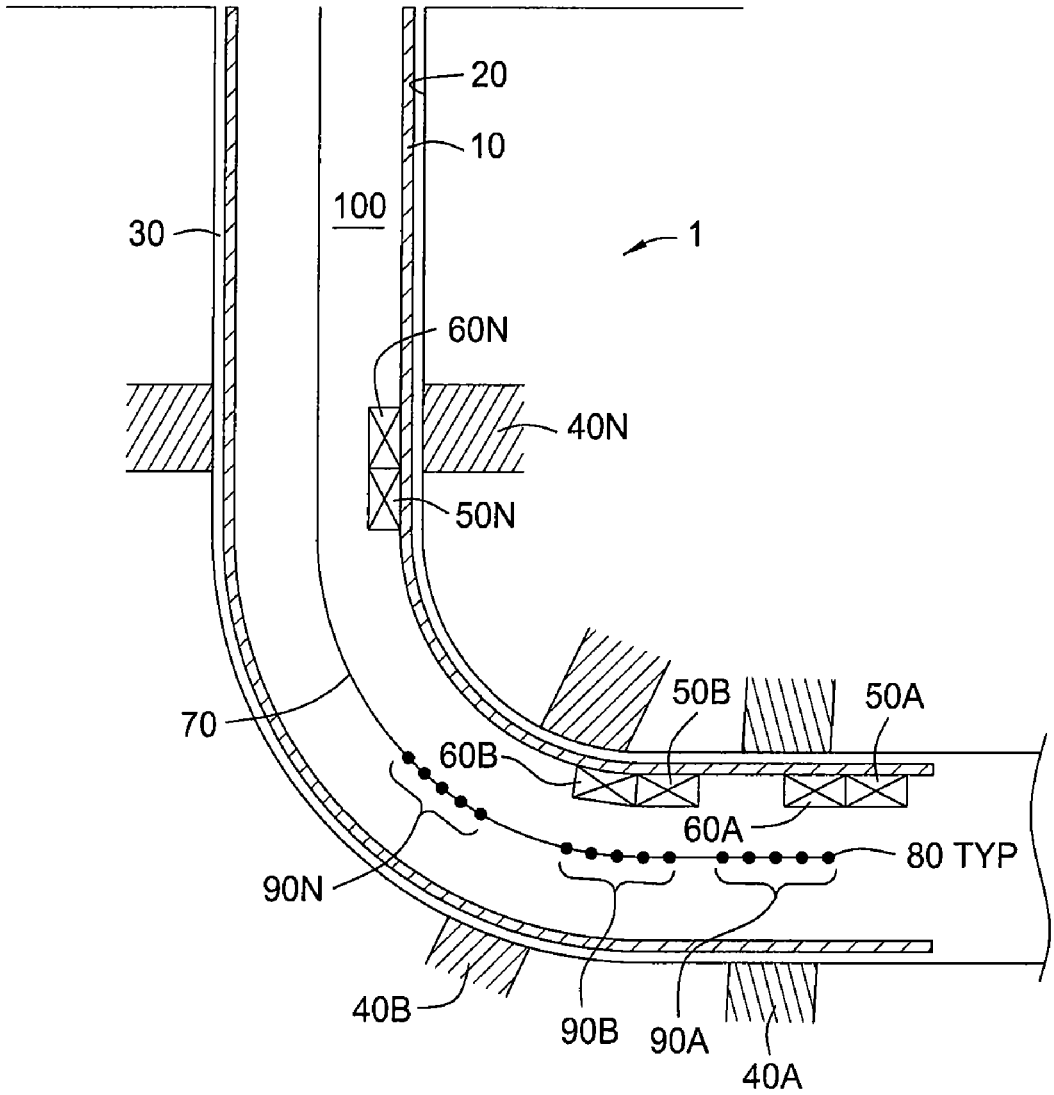
FIG. 1 is a schematic view of a wellbore according to one embodiment.

FIG. 1 shows a schematic view of a cased wellbore 1. The casing 10 is positioned inside the wellbore 1. An annulus 30 between the casing 10 and the wellbore 1 is typically filled with cement (not shown) in order to anchor the casing and isolate one or more production zones 40A-N, or formations. "A-N" is used herein to indicate a variable number of items so designated, where the number of such items may be one or more up to and including any number "N". Optionally, any item designated with the suffix "A-N" may include one or more whether or not the suffix is used in a given context. In one embodiment, one or more tools 50A-N is located in the casing string. Each of the tools 50A-N includes a fluid reservoir or chamber 60A-N for operating the respective tool 50A-N, as will be described in more detail below. An energetic device 90 or devices 90A-N are shown located within the casing 10. The one or more energetic devices 90A-N may comprise any suitable deformation and/or perforating mechanism. Exemplary energetic devices 90A-N include explosive shaped charge perforating guns, bulk explosive charges, wellbore perforating rotary drills and erosive fluid operated drills, compressed gas charges, and corrosive chemical based cutters and reduced pressure chambers ("atmospheric chambers"). Each of the energetic devices 90A-N is capable of deforming, perforating or impinging energy upon a boundary structure of one or more of the respective chambers or reservoirs 60A-N. In one embodiment, the energetic device 90 is a perforating gun which includes one or more shaped charges 80. Typically each charge 80 generates a metallic plasma jet when the charge is detonated and typically that jet hydrodynamically penetrates the surrounding casing and formations including the reservoir 60. One or more sets of charges 80 may be used in order to perforate multiple production zones 40A-N.

In use the energetic device (or devices) 90A-N is run into the wellbore 1 on a conveyance 70. The conveyance 70 may be a wire line, a slick line, coiled tubing, jointed tubing, or any other suitable conveyance mechanism. A plurality of energetic devices 90A-N may be lowered into the wellbore 1 on a common conveyance 70. Such a plurality may be configured to be selectively initiated such as one at a time, in predetermined groups or all at once. One or more energetic devices 90A-N each comprising one or more of the sets of charges 80 is located near the production zone 40A-N that is to be perforated. The charges 80 are initiated, thereby creating perforations through the casing 10 and into the surrounding formation 40A-N. At least one of the charges 80 also impinges upon a boundary of the reservoir or chamber 60A-N thereby causing the respective tool 50A-N to function, as will be described in more detail below. In one embodiment the tool 50A-N includes a valve member which closes a bore 100 of the casing 10. After the tool 50A-N is actuated, the energetic device 90 may be moved to another production zone 40 and the process repeated. In another embodiment, each of the one or more sets of charges 90A-N is spaced on the conveyance 70 to correspond with the locations of the production zones 40A-N. In that instance the energetic devices 90A-N may be initiated in sequence or at substantially the same time in order to perforate all of the formations 40A-N, without having to move the conveyance 70.

Figure 2:
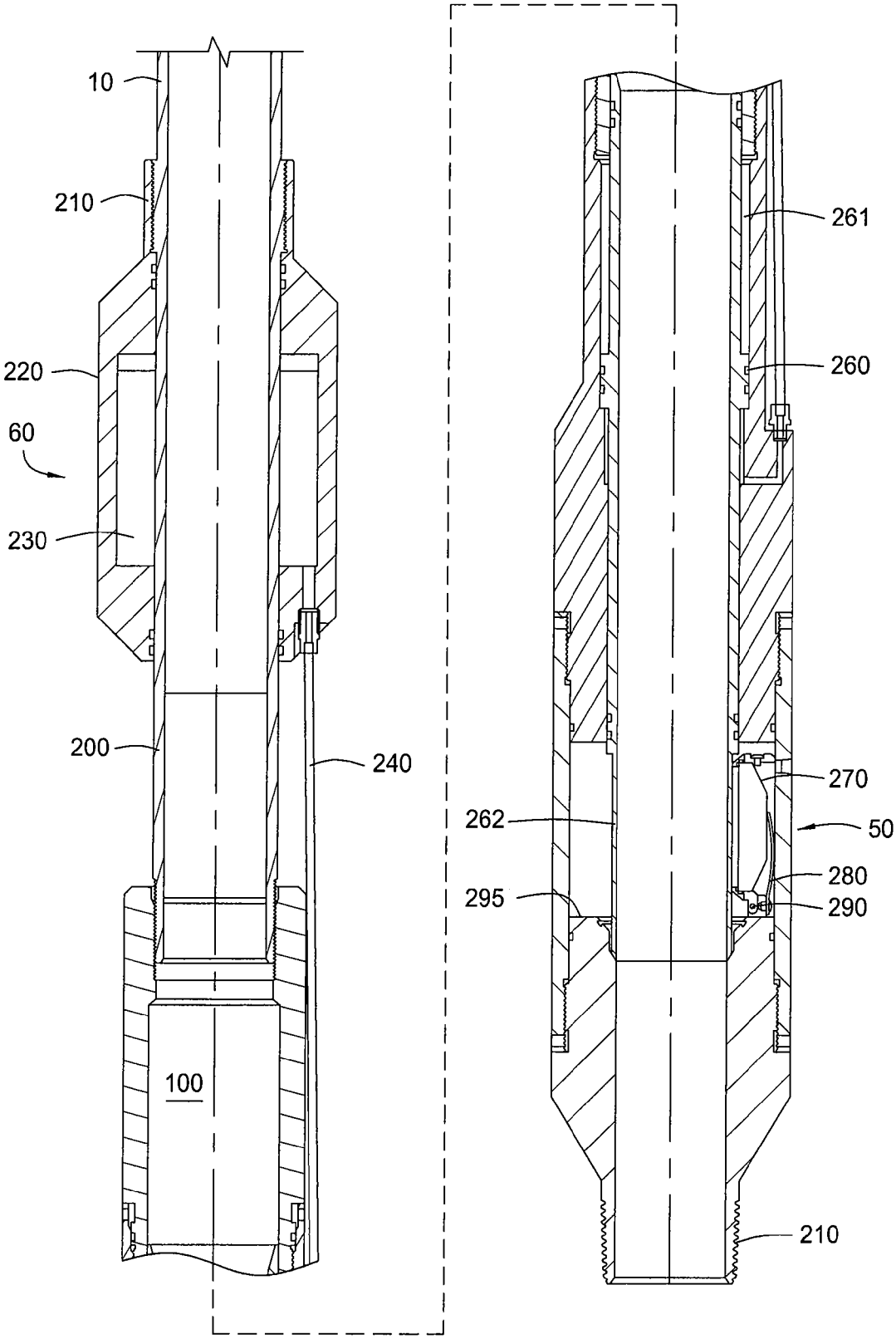
FIG. 2 is a schematic view of a downhole tool according to one embodiment.

FIG. 2 is a schematic of one embodiment of the tool 50 and the reservoir 60. The tool 50 and reservoir 60 are shown as separate and spaced components coupled together on a tubular 200; however, it should be appreciated that the tool 50 and the reservoir 60 may be integral components and may be coupled to a tubular sub or directly to the casing 10. The tubular 200 may be a part of or connected to any tubular string used downhole such as a casing, production tubing, liner, coiled tubing, drill string, etc. As shown the tubular 200 includes threads 210 for forming a threaded connection with the casing 10. The reservoir 60 has a chamber 220 for containing a fluid 230. The fluid 230 may be a gas or a liquid or any other suitable pressure transfer medium.

The chamber 220 is in fluid communication with a piston 260 via a control line 240. The chamber 220, as shown, is in fluid communication with a lower side of the piston 260 although it should be appreciated that the terms lower and upper and other directional terms used herein are only used for reference to the figures. A fluid within the piston chamber portion 261 above the piston 260 is preferably a gas and preferably at atmospheric pressure, although it should be appreciated that the fluid may be at other reduced pressures relative to the wellbore. Although the control line 240 is shown as an external line, it should be appreciated that the control line 240 may be integral with the tubular 200. As shown, the tool 50 includes a valve 270 having spring 280 for biasing the valve closed, and a hinge 290. As shown, the valve 270 is a flapper valve; however, it should be appreciated that the valve could be a ball valve, gate valve, butterfly valve or any other suitable valve. Further, the valve 270 includes a valve seat 295. The seat 295 allows the valve 270 to sealing obstruct the bore 100. In one embodiment, fluid pressure above the valve 270 holds the valve shut once the valve has been closed. If there is sufficient fluid pressure below the valve 270 to overcome bias of the spring 280 and any fluid pressure above the valve 270 the valve 270 will open allowing fluids to flow upward through the bore 100. A latch (not shown) may be used in order to hold the valve 270 in the closed position.

The piston 260 includes a valve retainer 262 coupled thereto or integral therewith. The valve retainer 262 retains the valve 270 in a casing bore open position. Alternatively, the valve retainer 262 may be operatively coupled to the valve member 270 or hinge 290 such that the valve retainer 262 may affirmatively move, or exert a motive force upon, the valve member 270 from a first position to a second position such as for example from an open position to a closed position or visa versa. The valve retainer 262 may comprise a rod, a bar, a key, a cylinder, a portion of a cylinder, a linkage, a cam, an abutment or any other suitable structure for retaining and/or moving the valve 270. In certain embodiments the valve retainer 262 is operatively connected to the hinge 290, for example at a location radially outward of the hinge pivot point of the hinge 290 such that upward movement of the valve retainer 262 acts to move the valve member 270 to a closed position and downward movement of the valve retainer 262 acts to move the valve member 270 to an open position.

Figure 3:
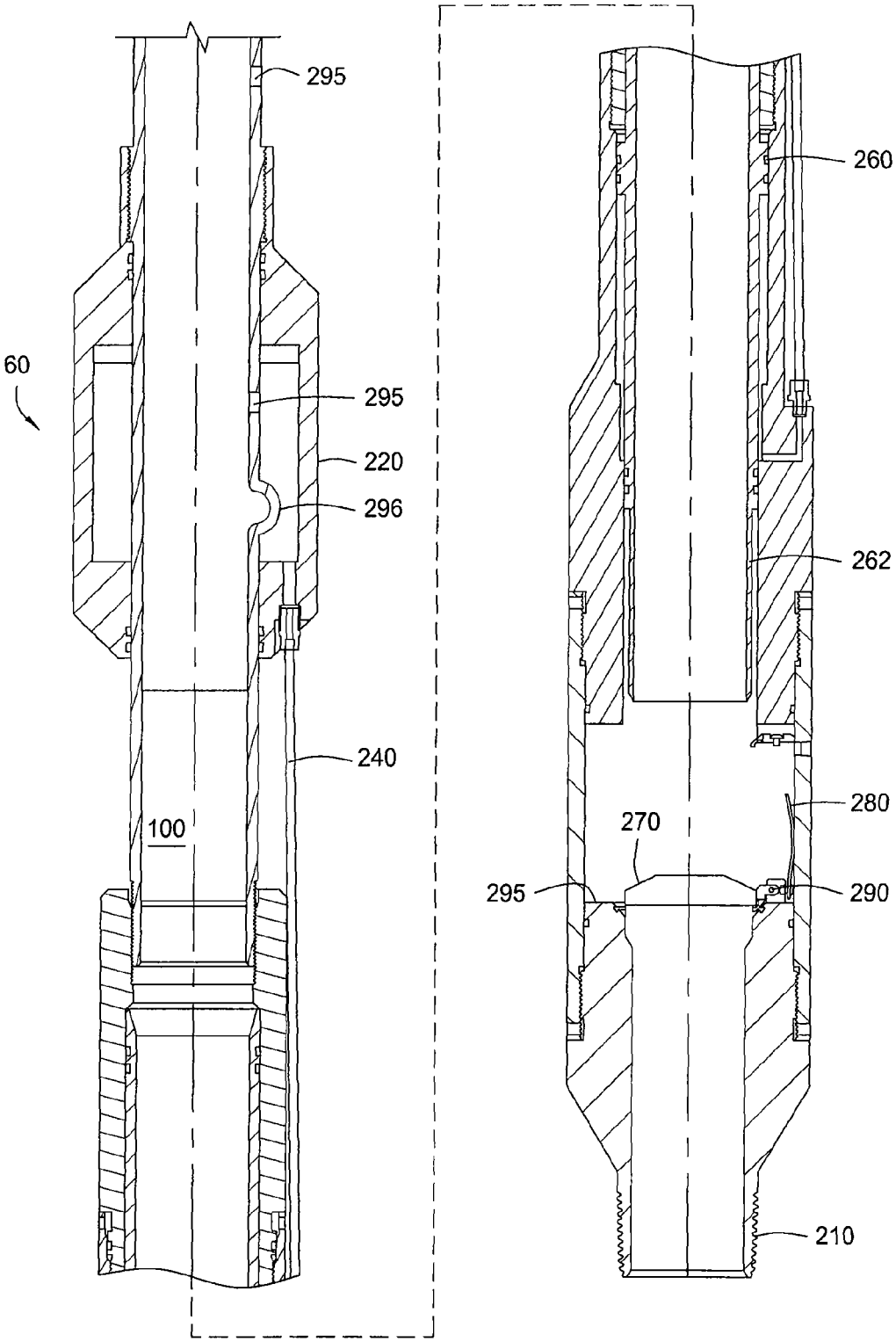
FIG. 3 is a schematic view of a downhole tool according to one embodiment.

Referring to FIGS. 1, 2 and 3, the tool 50 and reservoir 60, in operation, are lowered into the wellbore 1 preferably as part of a string of casing or liner. The fluid 230 in the chamber 220 may be pneumatic or hydraulic. The energetic device 90 is lowered into the bore 100 and initiated. The charge 80 of the energetic device 90 creates openings 295 in the casing wall and in the boundary of chamber 220. In the embodiment shown there is spacing between the reservoir 60 and the tool 50. Such spacing may help to reduce any possibility that the tool 50 would be damaged by a pressure impulse from the energetic device 90. Such spacing may be minimal or may be such that the reservoir 60 and the tool 50 are distanced by many joints of casing and depends on the embodiment used and other functional circumstances. One or more holes 295, as shown in FIG. 3, puncture the chamber 220. The wellbore fluids, not shown, enter the chamber 220 and apply wellbore pressure to the fluid 230. The wellbore pressure traverses through line 240 and exerts a force below piston 260. The piston 260 and valve retainer 262 move upward in response to the exerted pressure, toward a valve releasing position. As the piston 260 moves, the valve retainer 262 moves with it until the valve 270 is movable to close the bore 100. Once in the closed position fluid pressure from above the valve 270 and/or a latch (not shown) may hold the valve in the closed position.

In another embodiment, the fluid 230 is a hydraulic fluid. The energetic device 90 may be designed to create a dent 296 in the chamber 220. The energetic device 90 is initiated and thereby creates the dent 296. The dent 296 decreases the volume of the chamber 220 forcing the fluid 230 to traverse through line 240 and push the piston 260 upwardly. Optionally, the line 240 may extend to the surface of the wellbore, either directly or as an additional extension in fluid communication with an interior of chamber 220, and fluid pressure therein may be adjusted from the surface. As described above the piston 260 and the valve retainer 262 then move toward the valve releasing position and release the valve 270. Further, the energetic device 90 may create the hole 295 in the chamber 220. In that event, the valve will operate as described in the foregoing paragraphs.

Figure 4:
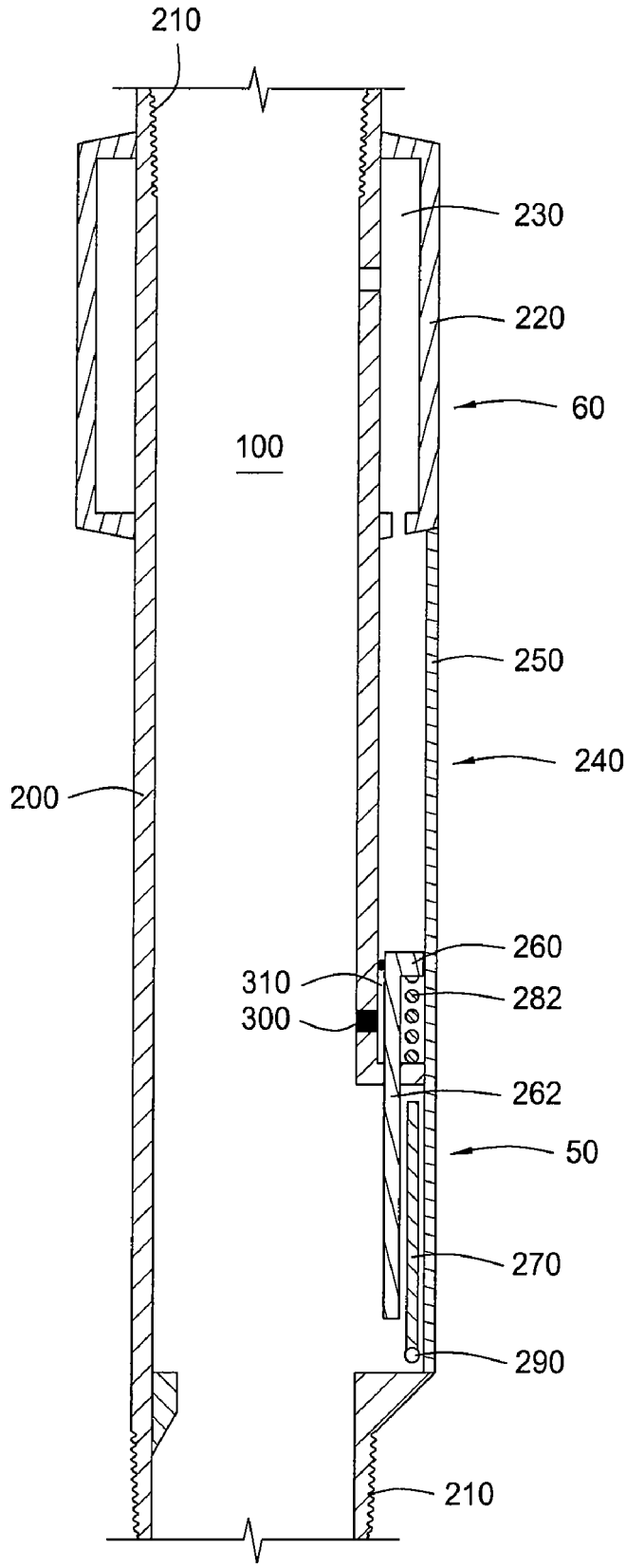
FIG. 4 is a schematic view of a downhole tool according to another embodiment.
Figure 5:
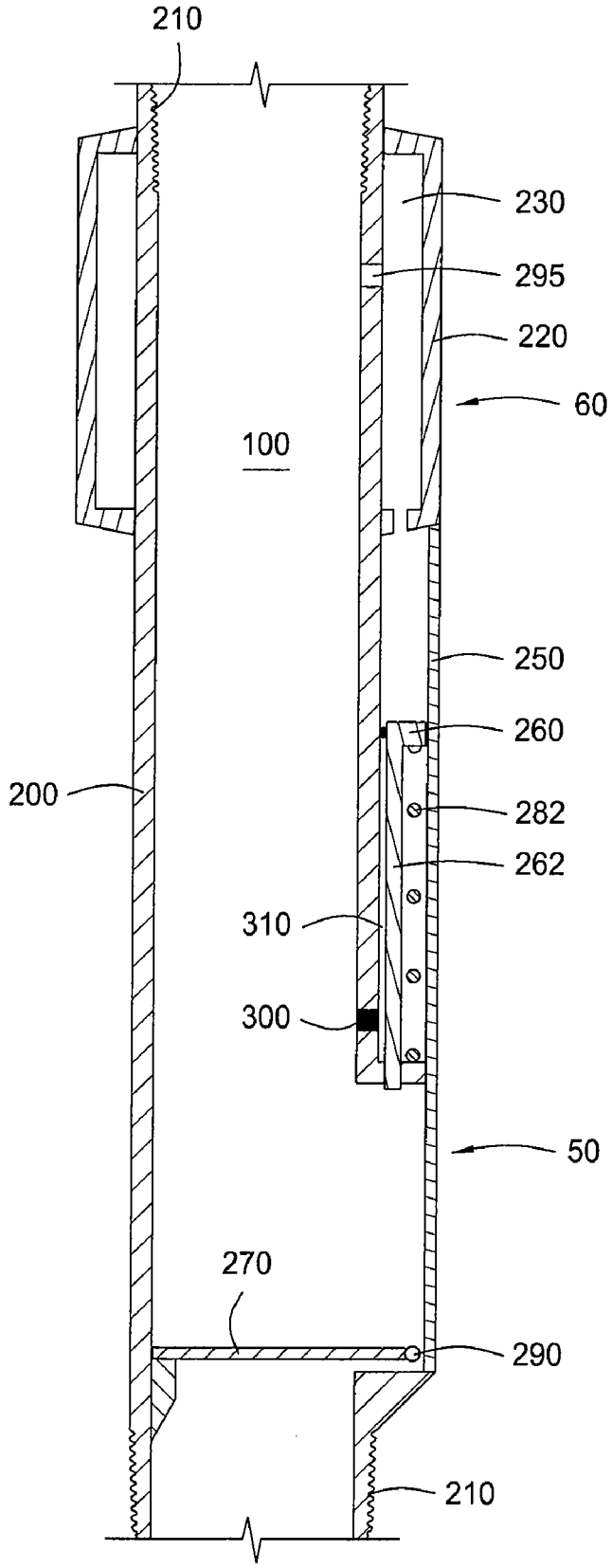
FIG. 5 is a schematic view of a downhole tool according to another embodiment.

In another embodiment, shown in FIGS. 4 and 5 the tool 50 and the reservoir 60 are particularly suited for use in wellbores having reduced hydrostatic pressure. The chamber 220 may be filled with a relatively incompressible fluid such as a water or oil based liquid. The chamber 220 is pressurized. That pressure may result from either exclusively or with additional overpressure, the force of the biasing member 282 exerted on the fluid in the closed chamber 220 through the piston 260 and is sufficient to maintain the biasing member 282 in a compressed position. The pressure in chamber 220 communicates to piston chamber 250 and in maintaining compression of the biasing member correspondingly maintains the piston 260 in a valve retaining position.

The chamber 220 is in fluid communication with a piston and cylinder assembly 240. The piston and cylinder assembly 240 includes a piston chamber 250 and the piston 260. The piston 260 moves upwardly in order to release the valve 270 to a casing bore closure position. The piston 260 may include a biasing member 282. The biasing member 282, as shown, is a coiled spring; however, it could be a stack of Belleville washers, a gas accumulator, a silicone oil "spring" or any other suitable biasing member. The biasing member 282 biases the piston 260 toward a valve releasing position. Optionally, a port 300 communicates wellbore pressure to a lower surface of piston 260.

A port 300, as shown, connects the bore 100 to a section 310 of the piston chamber 250 located on the biased or lower side of the piston 260. The port 300 may additionally or alternatively be arranged to connect the section 310 with an area exterior of the tubular 200. The port allows the section 310 to fill with wellbore fluids (not shown) as the tool 50 is lowered into the wellbore 1. As the fluid pressure in the bore 100 increases, the pressure in the section 310 increases. As the pressure in the section 310 increases, the piston 260 transfers that pressure to the fluid 230 on the opposite or upper side of the piston 260. However, the piston 260 will not move to the actuated position due to the pressure of the fluid 230 in the closed chamber 220.

In one embodiment, a surface control line (not shown) is connected to chamber 220 and in fluid communication with fluid 230. Such surface control line extends to the surface of the wellbore such that pressure within the surface control line and correspondingly the chamber 220 may be adjusted from the surface. Pressure may be bled from the surface control line whereby the biasing member 282 moves the valve retainer 262 upwardly and the valve 270 moves to a closed position. Optionally, the valve retainer 262 is operatively connected to the valve 270, for example by connection to the hinge 290. An increase in pressure within the surface control line and correspondingly above the piston 260 moves the valve retainer 262 downward and moves the valve 270 to an open position. Alternatively, such a pressure increase in the surface control line moves the valve retainer 262 downward and through the valve member 270 thereby bending, rupturing or shattering the valve member 270 and/or the hinge 290 such that the bore 100 is free from obstruction by the valve member 270.

Referring to FIGS. 1, 4 and 5, the tool 50 and reservoir 60 are lowered into the wellbore 1. The energetic device 90 is positioned such that at least a portion of energetic device 90 is proximate the reservoir 60. The energetic device 90 is actuated thereby creating one or more holes 295, as shown in FIG. 5, through a boundary of the chamber 220 and/or the piston chamber 250. The one or more holes 295 release the pressure in the chamber 220 and correspondingly piston chamber 250 thereby allowing pressure to escape into the wellbore and to equalize across the piston 260. The biasing member 280 then pushes the piston toward the valve releasing position. The piston 260 moves and the valve retainer 262 moves with it until the valve 270 are allowed to close the bore 100. The valve 270, as shown, is coupled with the tubular 200 by a hinge and may include a spring biasing the valve 270 to rotate about the hinge 290 toward the casing bore closed position. Therefore, the valve 270 automatically closes upon the piston 260 reaching the actuated position.

The valve 270 or valve member may be made of a dissolvable, breakable or frangible material, such as aluminum, plastic, glass or ceramic or any other suitable material. Such dissolvable or breakable material allows an operator to open the valve by shattering or dissolving it when desired. The valve member may be a ball valve and the piston may be coupled to a ball valve actuator whereby movement of the piston changes the position of the valve from, for example, open to closed, by rotating the ball through, for example, 90 degrees.

In one embodiment the reservoir 60 may include a "knock-off" or "break" plug (not shown) through a wall thereof and extending partially into the bore 100 of the casing. In that instance the energetic device 90 may comprise a weight bar or perforating gun body. A fluid communication path is formed through the boundary wall of the reservoir 60 by running the weight bar or gun body into the "break" plug thereby breaking the plug and opening the fluid path there through. Alternatively or additionally, a wall of the reservoir 60 may include a rupture disk in fluid communication with the bore 100. A fluid pressure impulse created in the bore 100 by the energetic device 90 ruptures the disk thereby opening a fluid flow path through a boundary wall of the reservoir 60.

In one operational embodiment it is desirable to treat hydrocarbon bearing formations with pressurized treatment fluids without making multiple trips into the wellbore. To ensure that a proper treatment is performed on a given formation, it is desired that the formation be isolated from other formations traversed by the wellbore during treatment. For performing a treatment operation in accordance with methods disclosed herein, the tools 50A-N, shown in FIG. 1, may be one or more of the valves 270 described above. The tools 50A-N are located below each of the respective production zones 40A-N. The energetic device 90A is lowered to the lower most production zone 40A. The energetic device 90A is initiated thereby perforating the production zone 40A and actuating the tool 50A. The tool 50A seals the bore 100 below the production zone 40A. Pressurized treatment fluids (not shown) are then introduced into the production zone 40A through the fluid flow paths or perforations created by the energetic device 90A. The tool 50A allows the bore 100 below the production zone 40A to remain isolated from the pressurized fluids while the treatment operation is performed. The energetic device 90B is located adjacent to the next production zone 40B. Alternatively, the expended energetic device 90A is removed from the wellbore and second and an unexpended energetic device 90B is lowered into the wellbore adjacent production zone 40B. The next production zone 40B is then perforated and the tool 50B seals the bore 100 thereby isolating the previously perforated and treated production zone 40A below the production zone 40B. Treatment fluids may then be introduced into the next production zone 40B through the perforations created by the energetic device 90B. The tool 50B isolates the next production zone 40B from the production zone 40A, thus allowing treatment of only the production zone 40B. This process may be repeated at any number of production zones 40A-N in the wellbore 1.

When the one or more treatment operations are complete, the wellbore may be prepared to produce production fluid. Production tubing (not shown) is run into the wellbore 1 above the uppermost tool 50N. The overbalanced hydrostatic pressure above the uppermost tool 50N is relieved until the pressure below the tool 50N is greater than the pressure above the tool 50N. The tool 50N may be one of the valves 270 described above. The tool 50N automatically opens when the pressure is greater below the tool 50N thereby allowing production fluids from the one or more production zones 40A-N to flow upwardly and into the production tubing (not shown). The production fluid continues to flow upward through the tools 50A-N as long as the pressure below the tools 50A-N is greater than the pressure above those respective tools. If the pressure above the tools 50A-N increases or the pressure below the tool decreases, the thus affected tool will automatically close the bore 100. In order to perform operations below the tools 50A-N once they are closed, it may be necessary to open the tools 50A-N. The tools 50A-N may be opened for example by breaking, dissolving, drilling through, or manipulation of the valve member. With the tool 50N open, for example, an operation may be performed below the tool 50N while a lower zone 40N−1 is still isolated by a subsequent tool 50N−1 (where N−1 may be A or B as shown on FIG. 1). The next tool 50N−1 may then be opened in order to perform additional operations below that next tool 50N−1.

While the foregoing is directed to exemplary embodiments, other and further embodiments may be devised without departing from the basic scope of the present invention, and the scope thereof is determined by the claims that follow.

The invention claimed is:

1. A well bore casing string comprising:

at least one valve member having a first position wherein a bore of a casing is substantially unobstructed and a second position wherein the bore is substantially closed;

at least one fluid chamber having a boundary comprising at least two spaced apart walls and having a first pressure configuration isolated from a fluid pressure and a second pressure configuration wherein the fluid pressure is communicated through an inner wall of said at least two spaced apart walls of the boundary of the chamber; and at least one valve retainer operatively coupled between the fluid chamber and the valve member, the valve retainer configured to move in response to the communicated fluid pressure and to thereby facilitate movement of the valve member from the first position to the second position.

2. The well bore casing string of claim 1, wherein the fluid pressure is higher than the first pressure configuration.

3. The well bore casing string of claim 1, wherein the fluid pressure is lower than the first pressure configuration.

4. The well bore casing string of claim 1, wherein the valve member comprises a flapper valve.

5. The well bore casing string of claim 1, wherein the valve member comprises a ball valve.

6. The well bore casing string of claim 1, wherein the valve retainer is configured to release the valve member from retention in the first position.

7. The well bore casing string of claim 1, wherein the valve retainer is configured to exert a motive force upon the valve member.

8. The well bore casing string of claim 1, wherein the second pressure configuration comprises a deformation of only said one wall.

9. The well bore casing string of claim 8, wherein the deformation comprises at least one opening through only said one wall.

10. The well bore casing string of claim 9, wherein the at least one opening comprises a drilled boundary.

11. The well bore casing string of claim 9, wherein the at least one opening comprises a perforation formed by at least one of erosion and corrosion.

12. The well bore casing string of claim 1, wherein the valve member is frangible.

13. The well bore casing string of claim 12, wherein the valve member comprises a ceramic material.

14. The well bore casing string of claim 13, wherein the ceramic material comprises glass.

15. The well bore casing string of claim 1, further comprising a biasing member configured to bias the valve member toward the second position.

16. The well bore casing string of claim 15, wherein the biasing member comprises a spring.

17. A method for isolating a portion of a well bore comprising:

providing a first fluid flow path having a first designated location, from the well bore to a formation surrounding the well bore and a valve member, configured to selectively obstruct a bore of casing located along the well bore between the first designated location and an earth surface opening of the well bore; and opening a second fluid flow path, having a second designated location, through a wall of the casing and obstructing the bore of the casing with the valve member, by activating a first energetic device, the second designated location being along the well bore between the valve member and the earth surface opening, wherein the valve member is operatively engaged with an initially closed fluid chamber comprising an inner wall and said step of obstructing comprises transferring fluid pressure through the inner wall of the fluid chamber by activating the first energetic device thereby moving the valve member.

18. The method of claim 17, further comprising opening a third fluid flow path having a third designated location, through the wall of the casing and obstructing the bore of the casing with a second valve member that is located along the well bore between the second designated location and the earth surface opening, by activating an energetic device, the third designated location being along the well bore between the second valve member and the earth surface opening.

19. The method of claim 18, wherein the energetic device is a second energetic device and further comprising removing the first energetic device.

20. The method of claim 18, wherein the energetic device comprises the first energetic device.

21. The method of claim 17, wherein at least a portion of the valve member is frangible.

22. The method of claim 21, wherein at least a portion of the valve member is glass.

23. The method of claim 21, further comprising breaking the frangible portion.

24. The method of claim 17, wherein transferring comprises deforming the boundary.

25. The method of claim 24, wherein deforming comprises drilling.

26. The method of claim 24, wherein deforming comprises at least one of eroding and corroding.

27. The method of claim 24, wherein deforming comprising perforating with an explosive charge.

28. The method of claim 24, wherein deforming comprises denting.

29. A downhole isolation valve for use in a tubular comprising:

a closed chamber comprising two boundary walls;

a fluid isolated within the closed chamber;

a valve retainer configured to move in response to a pressure change in the fluid;

an energetic device configured to initiate the pressure change upon impinging only an inner wall of the two boundary walls; and a valve member operatively engaged with the valve retainer and configured to move from a first position to a second position upon movement of the valve retainer.

30. The downhole isolation valve of claim 29, wherein the fluid is a hydraulic fluid.

31. The downhole isolation valve of claim 30, wherein the fluid is of a fixed volume within the chamber.

32. The downhole isolation valve of claim 29, further comprising a biasing member for biasing the valve retainer toward an actuated position.

33. The downhole isolation valve of claim 32, wherein the biasing member is a spring.

34. The downhole isolation valve of claim 32, further comprising a port for providing fluid communication between a biased side of the valve retainer and a bore of the tubular.

35. The downhole isolation valve of claim 29, further comprising a hole in only the inner wall of the two boundary walls of the closed chamber created by the energetic device configured to change the pressure in the fluid.

36. The downhole isolation valve of claim 29, further comprising a dent in only the inner wall of the two boundary walls of the closed chamber created by the energetic device configured to change the pressure in the fluid.

37. A well bore casing string comprising:

at least one valve member having a first position wherein a bore of a casing is substantially unobstructed and a second position wherein the bore is substantially closed;

at least one fluid chamber having a boundary comprising at least two spaced apart walls and having a first pressure configuration isolated from a fluid pressure and a second pressure configuration wherein the fluid pressure is communicated through an inner wall of said at least two spaced apart walls of the boundary of the chamber, said second pressure configuration comprises at least one detonated shaped charge perforation through only said inner wall; and at least one valve retainer operatively coupled between the fluid chamber and the valve member, the valve retainer configured to move in response to the communicated fluid pressure and to thereby facilitate movement of the valve member from the first position to the second position.

38. A method for isolating a portion of a well bore comprising:

providing a first fluid flow path having a first designated location, from the well bore to a formation surrounding the well bore and a valve member, configured to selectively obstruct a bore of casing located along the well bore between the first designated location and an earth surface opening of the well bore;

opening a second fluid flow path, having a second designated location, through a wall of the casing and obstructing the bore of the casing with the valve member, by activating a first energetic device, the second designated location being along the well bore between the valve member and the earth surface opening, wherein the valve member is operatively engaged with an initially closed fluid chamber comprising an inner wall and said step of obstructing comprises transferring fluid pressure through the inner wall of the fluid chamber by activating the first energetic device thereby moving the valve member; and flowing a fluid from the well bore through the second fluid flow path to an exterior of the casing.

39. A method for isolating a portion of a well bore comprising:

providing a first fluid flow path having a first designated location, from the well bore to a formation surrounding the well bore and a valve member, configured to selectively obstruct a bore of casing located along the well bore between the first designated location and an earth surface opening of the well bore;

opening a second fluid flow path, having a second designated location, through a wall of the casing and obstructing the bore of the casing with the valve member, by activating a first energetic device, the second designated location being along the well bore between the valve member and the earth surface opening, wherein the valve member is operatively engaged with an initially closed fluid chamber comprising an inner wall and said step of obstructing comprises transferring fluid pressure through the inner wall of the fluid chamber by activating the first energetic device thereby moving the valve member;

opening a third fluid flow path having a third designated location, through the wall of the casing and obstructing the bore of the casing with a second valve member that is located along the well bore between the second designated location and the earth surface opening, by activating an energetic device, the third designated location being along the well bore between the second valve member and the earth surface opening; and flowing a fluid from the well bore through the third fluid flow path to an exterior of the casing.

40. A method for isolating a portion of a well bore comprising:

providing a first fluid flow path having a first designated location, from the well bore to a formation surrounding the well bore and a valve member, configured to selectively obstruct a bore of casing located along the well bore between the first designated location and an earth surface opening of the well bore;

opening a second fluid flow path, having a second designated location, through a wall of the casing and obstructing the bore of the casing with the valve member, by activating a first energetic device, the second designated location being along the well bore between the valve member and the earth surface opening, wherein the valve member is operatively engaged with an initially closed fluid chamber comprising an inner wall and said step of obstructing comprises transferring fluid pressure through the inner wall of the fluid chamber by activating the first energetic device thereby perforating the inner wall with an explosive charge and moving the valve member.

* * * * *